US005794701A

United States Patent [19]

Cunningham et al.

[11] Patent Number: 5,794,701

[45] Date of Patent: Aug. 18, 1998

[54] SUBSEA CONNECTION

[75] Inventors: Michael Thomas Cunningham, Plantersville; Marcello Rosero, Houston; Jon Buck, Tomball; Mario R. Lugo, Houston, all of Tex.

[73] Assignee: Oceaneering International, Inc., Tomball, Tex.

[21] Appl. No.: 662,809

[22] Filed: Jun. 12, 1996

[51] Int. Cl.[6] ..... E21B 43/013

[52] U.S. Cl. ..... 166/341; 166/344; 166/380

[58] Field of Search ..... 166/341, 344, 166/338, 351, 380

[56] References Cited

U.S. PATENT DOCUMENTS

| | | | |
|---|---|---|---|
| 3,586,048 | 6/1971 | Arnold | 137/614.04 |
| 4,035,005 | 7/1977 | DeVincent et al. | 285/319 |
| 4,566,489 | 1/1986 | Knapp et al. | 137/614 |
| 4,730,677 | 3/1988 | Pearce et al. | 166/345 |
| 4,943,187 | 7/1990 | Hopper | 166/341 X |
| 5,265,980 | 11/1993 | Lugo et al. | 166/347 X |
| 5,333,691 | 8/1994 | Dan et al. | 166/341 |
| 5,466,017 | 11/1995 | Szabo et al. | 285/319 |

*Primary Examiner*—Frank Tsay
*Attorney, Agent, or Firm*—Rosenblatt & Redano P.C.

[57] ABSTRACT

A connection is disclosed which is particularly applicable to subsea wellheads. A female receptacle end is provided on the wellhead which has connections on it to an umbilical or a flowline. The male end has an orientation lug for rough orientation. Once rough orientation is made, the male end is advanced into the female end and the shaft rotated by a remotely operated vehicle (ROV) for alignment of lugs with a detent. Once the lugs advance past the detent, they are rotated so that a segment of the shaft on the male end of the connection can no longer turn. Further rotational movements by the ROV on another portion of the shaft advances a plate which makes up the connection, either for the umbilical or the flowline.

20 Claims, 2 Drawing Sheets

SUBSEA CONNECTION

FIELD OF THE INVENTION

This field of this invention relates to connectors, more particularly connectors for umbilicals or flowlines, typically engaged or disengaged by remote-operated vehicles.

BACKGROUND OF THE INVENTION

In operations involving subsea wellheads, connections are frequently made using remote-operated vehicles (ROVs). The ROV can approach a subsea wellhead and connect an umbilical which is a bundle of control lines, typically used for control of the subsea wellhead and subsurface components, such as a subsurface safety valve. Additionally, a flowline can be connected to the subsea wellhead in a similar manner. In the past, the ROV grasped one-half of the connection which generally contained a centrally mounted shaft having a leading thread. The male thread on the shaft had to be aligned by the ROV to a female thread in the receptacle and thereafter rotational movement of the shaft initiated by the ROV would make up the joint. The difficulties that were encountered in the prior design related to potentials for misalignment between the threaded components which could result in cross-threading. Additionally, any contaminants on the receptacle end of the thread could also hamper the threading operation and prevent the complete sealing of the mating halves of the connection.

Accordingly, it is an object of the present invention to improve the prior designs and to facilitate the alignment between the connection parts prior to securing them together. The need to mate up thread components between the ROV and the subsea wellhead is eliminated in the new design. As a further objective of the new design, the initial interengagement between the mating components does not depend on a threaded connection. Upon interlocking the two segments of the connection to each other, further movement by the ROV of one portion of the connection advances the components together.

SUMMARY OF THE INVENTION

A connection is disclosed which is particularly applicable to subsea wellheads. A female receptacle end is provided on the wellhead which has connections on it to an umbilical or a flowline. The male end has an orientation lug for rough orientation. Once rough orientation is made, the male end is advanced into the female end and the shaft rotated by a remotely operated vehicle (ROV) for alignment of lugs with a detent. Once the lugs advance past the detent, they are rotated so that a segment of the shaft on the male end of the connection can no longer turn. Further rotational movements by the ROV on another portion of the shaft advances a plate which makes up the connection, either for the umbilical or the flowline.

DETAILED DESCRIPTION OF THE PREFERRED EMBODIMENT

Figure 1:
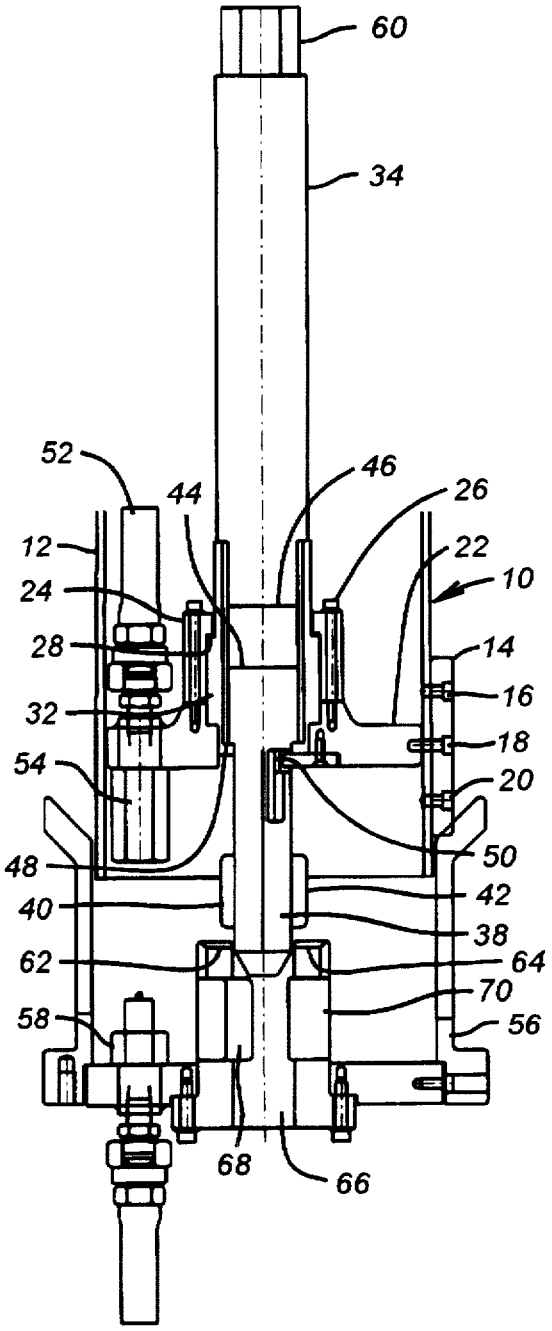
FIG. 1 illustrates in sectional elevational view the two components being brought together and coarsely aligned with a lug.

The apparatus of the present invention is illustrated in FIG. 1 as the two segments of the connection are initially brought together. The male segment 10 has a cylindrically shaped body 12, with at least one orientation lug 14. Lug 14 is attached to body 12 by fasteners 16, 18, and 20. Body 12 also has a plate 22. Connected to plate 22 is ring 24, which is held down by fasteners 26. Ring 24 has a shoulder 28 which engages shoulder 30 on ring 32. Ring 32 is connected to upper shaft 34 at grooves 36. The upper shaft 34 rotates in tandem with ring 32 due to the manner of connection into grooves 36. A lower shaft 38 has a pair of tabs 40 and 42 extending radially outwardly. The lower shaft 38 itself extends into ring 32 where there exists a gap between the upper end 44 of the lower shaft 38 and the lower end 46 of the upper shaft 34. Ring 32 has an inwardly extending shoulder 48 which retains the lower shaft 38 within the ring 32, yet permits some relative movement therebetween. The shoulder 48 has a thread which engages thread 50 on lower shaft 38. Plate 22 supports line 52 which can be an umbilical or a flowline for a well. Line 52 terminates in a female connector 54. When lug 14 is aligned with a mating groove (not shown) in the female segment 56, the female connector 54 is in general alignment with the male connector 58, but in the position shown in FIG. 1, although no contact is yet made.

In operation of the connection, the male segment 10 is aligned with the female segment 56 such that the lug 14 is in alignment with a groove in the female segment 56. Having made such a preliminary alignment, the upper shaft 34 is manipulated counterclockwise at hex end 60 by an ROV. Once a travel stop is reached, the tabs 40 and 42 are in alignment with openings 62 and 64, respectively, in retainer 66.

Figure 2:
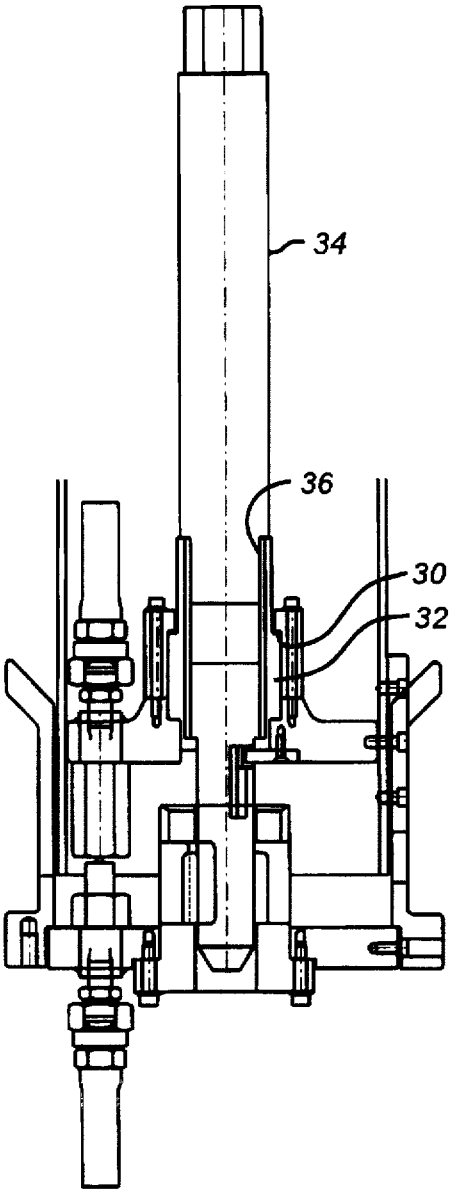
FIG. 2 is the view of FIG. 1, showing how the small lugs on the lower shaft have passed into the detent.
Figure 3:
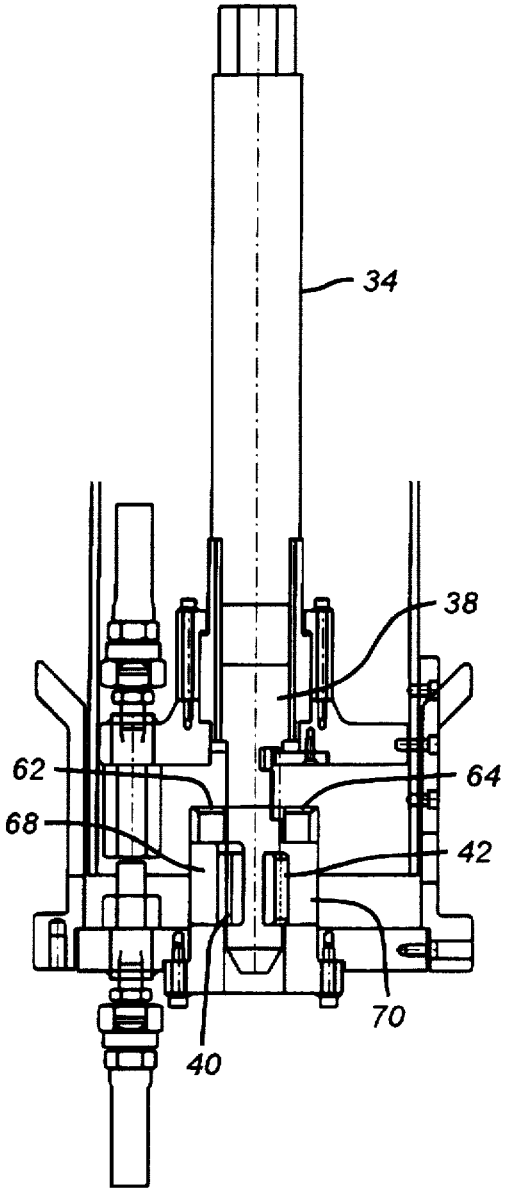
FIG. 3 is the view of FIG. 2, showing entrapment of the lugs on the lower shaft prior to relative rotation of the upper shaft.

As shown by a comparison between FIGS. 1 and 2, when the tabs 40 and 42 are in alignment with openings 62 and 64, they can literally advance until tabs 40 and 42 are in alignment with windows 68 and 70. At this point, the ROV turns the upper shaft 34 clockwise until the tabs 40 and 42 are transverse to openings 62 and 64 and are incapable of turning further because each of the tabs 40 and 42, respectively, have come to the end of windows 68 and 70, or any other rotational travel stop. At this point, the lower shaft 38 can rotate no further in a clockwise direction and at the same time, due to the misalignment between tabs 40 and 42 and openings 62 and 64, the lower shaft 38 cannot move sufficiently longitudinally for a release from the retainer 66. Thus, FIG. 2 shows the advancement of the tabs 40 and 42 beyond openings 62 and 64 prior to the initiation of clockwise rotation. After clockwise rotation, the position of FIG. 3 is reached, where the tabs 40 and 42 are out of alignment with openings 62 and 64. As shown in FIG. 3, since there is still a net inward force on upper shaft 34 which is communicated to lower shaft 38, the tabs 40 and 42 are bottomed in the windows 68 and 70.

In this position, the thread 50 is now stationary because the tabs 40 and 42 can no longer turn. Accordingly, further clockwise rotation of upper shaft 34 through ring 32, which is connected to the thread 50, advances lower shaft 38 toward upper shaft 34. At the same time, the plate 22 is pulled downwardly until it contacts surface 72 of the retainer 66. Thus, with the tabs 40 and 42 restrained against further upward motion when they contact surface 74 of retainer 66, the female connector 54 is drawn down on the male connector 58 in a sealing relationship.

Figure 4:
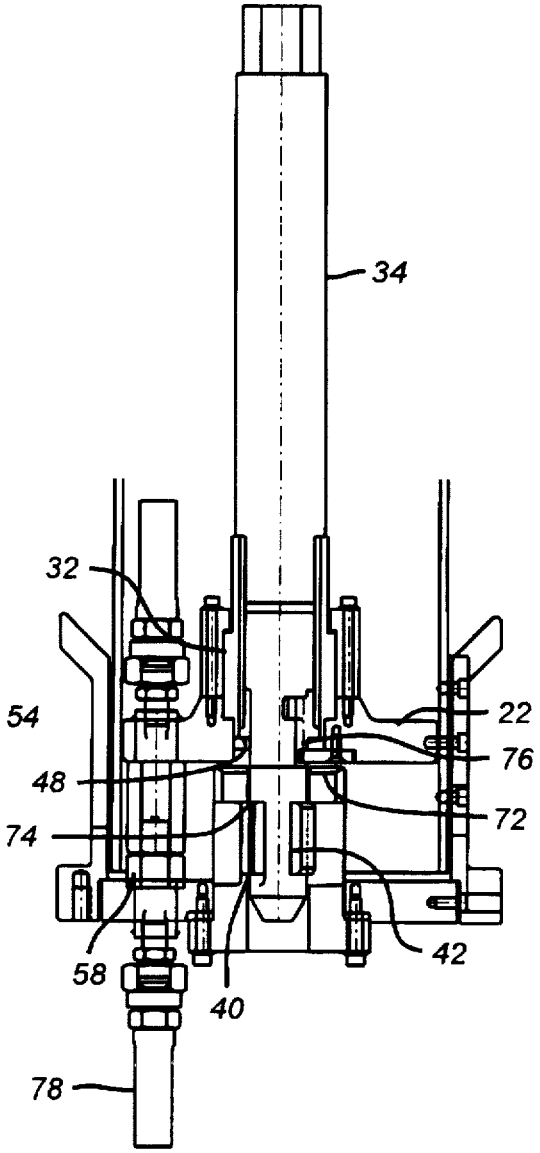
FIG. 4 shows the result of rotation of the upper shaft which brings the plate downwardly, thus completing the connection for the umbilical or flowline.

This tightening of the connection as illustrated by comparing FIGS. 3 and 4 occurs because tandem rotation of upper shaft 34 with ring 32 at first, through the interaction of thread 50 with ring 32 which has a thread 76 adjacent the shoulder 48, the tabs 40 and 42 are drawn upwardly, while at the same time the plate 22 is drawn downwardly. Eventually, both the plate 22 and the tabs 40 and 42 reach their limit of longitudinal travel, at which point the female connector 54 is in sealing engagement with the male connector 58. Male connector 58 leads to the well through conduit 78. The joint can be taken apart by reversing the rotation on upper shaft 34 with an ROV. The above-described movements are simply reversed to result in a release between the male segment 10 and the female segment 56.

Those skilled in the art can appreciate that the dangers of cross-threading are eliminated by this design. The initial link-up of the male segment 10 with the female segment 56 is a bayonet-type connection using the tabs 40 and 42 passing through openings 62 and 64, only to be turned for the initial engagement. Once the initial engagement is made without a threaded connection, the ROV supplies the rotational force to the hex head 60 to bring the trapped tabs 40 and 42 and the plate 22 closer together until they are both firmly against the retainer 66. When they achieve that position, the male connector 58 is in a sealing relationship with the female connector 54. While only a single connection (ie., connectors 54 and 58) is illustrated, those skilled in the art will appreciate that a multiplicity of such connections can be made up all at once with a single operation.

Thus, the ROV (not shown) does not need to achieve perfect alignment to complete the connection as with the past designs which involved the thread on both segments. Here, with only a coarse alignment, the two components of the connection 10 and 56 can be initially secured together for a rotational force which cannot result in cross-threading. Additionally, since the gaps for the windows 68 and 70 are fairly large, even if some foreign materials lodge in that area or settle there, the connection can still be made. This is to be distinguished from the old-style joints wherein a thread had to be started properly for the joint to be brought together so that connectors such as 54 and 58 could come together in a sealing relationship.

The foregoing disclosure and description of the invention are illustrative and explanatory thereof, and various changes in the size, shape and materials, as well as in the details of the illustrated construction, may be made without departing from the spirit of the invention.

we claim:

1. A subsea connection, comprising:

a female component having at least one first fluid-conducting line extending therefrom;

a male component having at least one second fluid-conducting line and selectively connected to said female component so as to sealingly engage said first and second fluid-conducting lines in flow communication;

said male and female components are configured so they can selectively retain each other by a rotationally operated detent mechanism on said components at a location offset from said first and second fluid-conducting lines.

2. A method of assembling a subsea connection, which when completed sealingly connects at least one fluid conduit to another, comprising:

aligning a female component of the subsea connection, which supports a first conduit segment, with a male component of the subsea connection which supports a second fluid conduit segment in opposition to said first fluid conduit;

loosely trapping said male component to said female component using a nonthreaded receptacle;

drawing a plate which supports one of said conduit segments against said receptacle; and sealingly connecting said conduit segments by said drawing of said plate.

3. The method of claim 2, further comprising:

providing a shaft with at least one lug on said male component;

providing an opening into said receptacle that accepts said lug when oriented with said opening and traps it longitudinally when said lug is misaligned with said opening.

4. The method of claim 3, further comprising:

providing a rotational travel stop for said lug in said receptacle.

5. The method of claim 4, further comprising:

providing said shaft as a two-piece shaft with an upper and lower portion;

mounting said lug on said lower portion of said two-piece shaft;

providing a thread on said lower portion of said shaft;

engaging an upper portion of the shaft to said thread to permit relative rotation between said upper and lower portions;

advancing said plate toward said receptacle by virtue of said relative rotation.

6. The method of claim 5, further comprising:

using said receptacle to prevent said thread on said lower portion of said shaft from turning.

7. The method of claim 5, further comprising:

providing a coupling which engages said upper portion of said shaft and said thread while leaving enough space between said upper and lower shaft portions to allow said upper portion of said shaft to approach said lower portion when said upper portion is turned while said lower portion is rotationally trapped in said receptacle.

8. The method of claim 6, further comprising:

using relative rotation between said upper and lower shaft components to draw said lug against said receptacle on one side while drawing said plate toward said receptacle.

9. The method of claim 8, further comprising:

using a remotely operated vehicle to support said male component and to align it with said female component.

10. The method of claim 9, further comprising using a plurality of conduit segments in said male component to sealingly engage a plurality of conduit segments in said female component when said male and female components are drawn toward each other.

11. The method of claim 2, further comprising:

providing a guide lug on a shaft on said male component;

providing a guide groove on the receptacle of said female component to accept said guide lug;

advancing said guide lug past said guide groove;

rotating said guide lug less than 180° into an opening in said receptacle;

stopping rotational motion of said guide lug in a position where it is misaligned with said guide groove.

12. A subsea connection, comprising:

a female component having at least one first fluid-conducting line extending therefrom;

a male component having at least one second fluid-conducting line and selectively connected to said female component so as to sealingly engage said first and second fluid-conducting lines in flow communication;

said male and female components are configured so they can retain each other by a detent mechanism on said components;

said detent mechanism further comprises:

a shaft mounted to one of said male and female components and having at least one tab thereon and a receptacle formed on the other of said male and female components capable of letting said tab advance into it when said tab is aligned with at least one opening on it and to retain said tab when said shaft is rotated after insertion of said tab through said opening.

13. The device of claim 12, wherein:

said shaft comprises a first and second component;

said tab mounted to said second component;

said first component comprising a support plate for said second fluid-conducting line;

whereupon insertion of said tab in said receptacle, said plate is on the opposite side of said receptacle from said tab.

14. The device of claim 13, wherein:

said plate is mounted to said first component so that said plate can translate but not rotate.

15. The device of claim 14, wherein:

said second component of said shaft has an exposed thread operably engaged to said first component of said shaft.

16. The device of claim 15, wherein:

said receptacle rotationally traps said tab, preventing said exposed thread, from further rotating.

17. The device of claim 16, wherein:

said receptacle also limits longitudinal movement of said tab.

18. The device of claim 17, wherein:

said first component of said shaft rotatable with respect to said second component of said shaft along said exposed thread;

whereupon rotation of said first component with said tab trapped in said receptacle draws said plate toward said receptacle and in turn brings said first fluid conduct into a sealing relation with said second fluid conduit.

19. The device of claim 18, wherein:

said receptacle has an annular shape with a window which limits the amount of rotation of said tab after it passes through said opening;

said receptacle having a closed top around an opening which accepts said second component of said shaft and said tab.

20. The device of claim 19, wherein:

relative rotation between said first and second components of said shaft draws both said tab and said plate toward said top on opposite sides thereof.

* * * * *

US005794701C1

(12) EX PARTE REEXAMINATION CERTIFICATE (5321st)

United States Patent
Cunningham et al.

(10) Number: US 5,794,701 C1
(45) Certificate Issued: Apr. 4, 2006

(54) SUBSEA CONNECTION

(75) Inventors: Michael Thomas Cunningham, Plantersville, TX (US); Marcello Rosero, Houston, TX (US); Jon Buck, Tomball, TX (US); Mario R. Lugo, Houston, TX (US)

(73) Assignee: Oceaneering International, Inc., Tomball, TX (US)

Reexamination Request:
No. 90/006,154, Dec. 4, 2001

Reexamination Certificate for:

| | |
|---|---|
| Patent No.: | **5,794,701** |
| Issued: | **Aug. 18, 1998** |
| Appl. No.: | **08/662,809** |
| Filed: | **Jun. 12, 1996** |

(51) Int. Cl.
*E21B 43/013* (2006.01)

(52) U.S. Cl. ..... 166/341; 166/344; 166/380
(58) Field of Classification Search ..... 166/341, 166/344, 338, 351, 380
See application file for complete search history.

(56) References Cited

U.S. PATENT DOCUMENTS

| | | | | | |
|---|---|---|---|---|---|
| 3,586,048 | A | * | 6/1971 | Arnold | 137/614.04 |
| 4,035,005 | A | * | 7/1977 | DeVincent et al. | 285/319 |
| 4,566,489 | A | * | 1/1986 | Knapp et al. | 137/614 |
| 4,730,677 | A | * | 3/1988 | Pearce et al. | 166/345 |
| 4,943,187 | A | * | 7/1990 | Hopper | 405/190 |
| 5,265,980 | A | | 11/1993 | Lugo et al. | 405/169 |
| 5,333,691 | A | * | 8/1994 | Dean et al. | 166/341 |
| 5,466,017 | A | * | 11/1995 | Szabo et al. | 285/319 |
| 5,743,670 | A | * | 4/1998 | Ader | 403/296 |
| 6,558,537 | B1 | * | 5/2003 | Herrington et al. | 210/192 |

OTHER PUBLICATIONS

"Diverless Maintained Cluster (DmaC) Subsea Production System", Offshore Technology Conference, 1991.

* cited by examiner

*Primary Examiner*—William Neuder

(57) ABSTRACT

A connection is disclosed which is particularly applicable to subsea wellheads. A female receptacle end is provided on the wellhead which has connections on it to an umbilical or a flowline. The male end has an orientation lug for rough orientation. Once rough orientation is made, the male end is advanced into the female end and the shaft rotated by a remotely operated vehicle (ROV) for alignment of lugs with a detent. Once the lugs advance past the detent, they are rotated so that a segment of the shaft on the male end of the connection can no longer turn. Further rotational movements by the ROV on another portion of the shaft advances a plate which makes up the connection, either for the umbilical or the flowline.

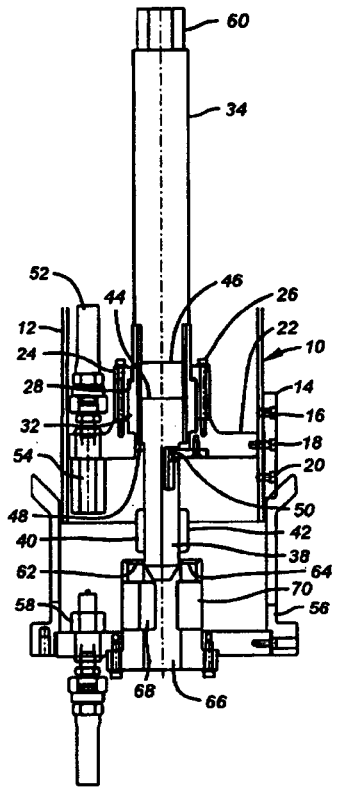

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–20 is confirmed.

New claims 21–31 are added and determined to be patentable.

*21. The subsea connector of claim 1 wherein said female component and said male component are cylindrically shaped.*

*22. The subsea connection of claim 1 wherein said detent mechanism comprises a shaft mounted to one of said male and female components and having at least two tabs thereon and said detent mechanism further comprises a receptacle formed in the other of said male and female components, said receptacle comprising at least two openings capable of receiving the tabs on said shaft when said tabs are aligned with said openings, and further capable of retaining said tabs when said shaft is rotated after insertion through said openings.*

*23. The subsea connection of claim 1 further comprising:*

*a. a first alignment member mounted on said male component; and*

*b. a second alignment member mounted on said female component and positioned such that when the first alignment member engages the second alignment member, the first fluid conducting line is in alignment with the second fluid conducting line.*

*24. A subsea connection, comprising:*

*a. a cylindrical female component having at least one first fluid conducting line extending therefrom;*

*b. a cylindrical male component having at least one second fluid conducting line and connected to the female component so as to sealingly engage the first and second fluid conducting lines in flow communication;*

*c. a male detent member mounted on the male component, the male detent member comprising a shaft and at least one tab mounted on the end region of the shaft, the shaft extending in longitudinal alignment with at least one of the fluid conducting lines; and*

*d. a female detent member mounted on the female component, and being sized and positioned such that it can receive the tab when said tab is properly aligned with the female detent member and further retain the tab after the tab has been received and the shaft is rotated.*

*25. The subsea connection of claim 24 wherein the male detent member is centrally located in the male component and the female detent member is centrally located in the female component.*

*26. The subsea connection of claim 25 wherein the female detent member is in longitudinal alignment with at least one of the fluid conducting lines.*

*27. The subsea connection of claim 24 wherein the cylindrical male component comprises an outer cylindrical wall that defines an internal cylindrical volume.*

*28. The subsea connection of claim 27 wherein the male detent member is centrally mounted in the radial dimension of the internal cylindrical volume.*

*29. The subsea connection of claim 28 wherein the second fluid conducting line is positioned radially between the male detent member and the outer cylindrical wall, and the first fluid conducting line is positioned in radial alignment with the second fluid conducting line.*

*30. A subsea connection, comprising:*

*a. a cylindrical female component having at least one first fluid conducting line extending therefrom;*

*b. a cylindrical male component having at least one second fluid conducting line and connected to the female component so as to sealingly engage the first and second fluid conducting lines in flow communication;*

*c. a male detent member mounted in a radially central location of the male component, the male detent member comprising a shaft and at least one tab mounted on the end region of the shaft, the shaft extending in longitudinal alignment with at least one of the fluid conducting lines; and*

*d. a female detent member mounted in a radially central location of the female component, and being sized and positioned such that it can receive the tab when said tab is properly aligned with the female detent member and further retain the tab after the tab is has been received and the shaft is rotated.*

*31. The subsea connector of claim 30 wherein the first fluid conducting line is radially offset from the female detent member, and the second fluid conducting line is radially offset from the male detent member.*

* * * * *

US005794701C2

(12) EX PARTE REEXAMINATION CERTIFICATE (5774th)

United States Patent
Cunningham et al.

(10) Number: US 5,794,701 C2
(45) Certificate Issued: Jun. 5, 2007

(54) SUBSEA CONNECTION

(75) Inventors: Michael Thomas Cunningham, Plantersville, TX (US); Marcello Rosero, Houston, TX (US); Jon Buck, Tomball, TX (US); Mario R. Lugo, Houston, TX (US)

(73) Assignee: Oceaneering International, Inc., Tomball, TX (US)

Reexamination Request:
No. 90/007,863, Jan. 3, 2006

Reexamination Certificate for:

| | |
|---|---|
| Patent No.: | **5,794,701** |
| Issued: | **Aug. 18, 1998** |
| Appl. No.: | **08/662,809** |
| Filed: | **Jun. 12, 1996** |

Reexamination Certificate B1 5,794,701 issued Apr. 4, 2006

(51) Int. Cl.
*E21B 43/013* (2006.01)

(52) U.S. Cl. ..... 166/341; 166/344; 166/380
(58) Field of Classification Search ..... None
See application file for complete search history.

(56) References Cited

U.S. PATENT DOCUMENTS 3,688,840 A * 9/1972 Curington et al. ..... 166/341

FOREIGN PATENT DOCUMENTS

DE 2811212 A1 * 9/1978

* cited by examiner

*Primary Examiner*—Michael O'Neill

(57) ABSTRACT

A connection is disclosed which is partially applicable to subsea wellheads. A female receptacle end is provided on the wellhead which has connections on it to an umbilical or a flowline. The male end has an orientation lug for rough orientation. Once rough orientation is made, the male end is advanced into the female end and the shaft rotated by a remotely operated vehicle (ROV) for alignment of lugs with a detent. Once the lugs advance past the detent, they are rotated so that a segment of the shaft on the male end of the connection can no longer turn. Further rotational movements by the ROV on another portion of the shaft advances a plate which makes up the connection, either for the umbilical or the flowline.

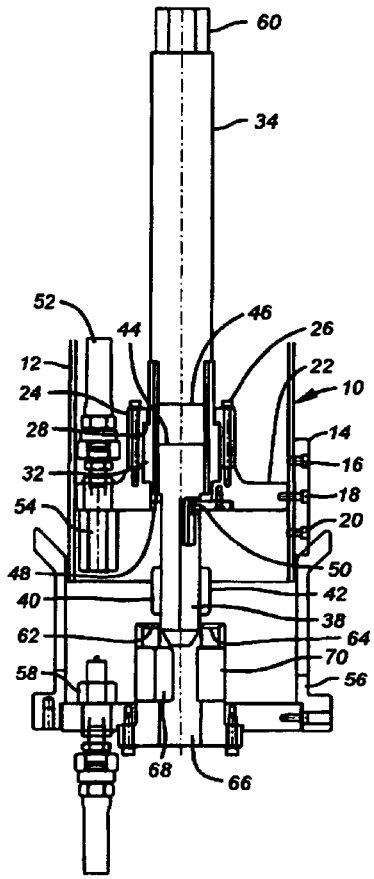

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-31 is confirmed.

* * * * *